US007358452B2

(12) United States Patent
Beerling et al.

(10) Patent No.: US 7,358,452 B2
(45) Date of Patent: Apr. 15, 2008

(54) ARCHITECTURE AND METHOD OF FABRICATION FOR A LIQUID METAL MICROSWITCH (LIMMS)

(75) Inventors: Timothy Beerling, San Francisco, CA (US); Steven A. Rosenau, Mountain View, CA (US); Benjamin P. Law, Fremont, CA (US); Ronald Shane Fazzio, Loveland, CO (US); Marco Aimi, Menands, NY (US)

(73) Assignee: Agilent Technlolgies, Inc., Santa Clara, CA (US)

( * ) Notice: Subject to any disclaimer, the term of this patent is extended or adjusted under 35 U.S.C. 154(b) by 266 days.

(21) Appl. No.: 11/171,610

(22) Filed: Jun. 30, 2005

(65) Prior Publication Data

US 2007/0000762 A1 Jan. 4, 2007

(51) Int. Cl.
*H01H 29/00* (2006.01)

(52) U.S. Cl. ..... 200/182; 200/191; 200/228

(58) Field of Classification Search ..... 200/182, 200/187–189, 191–194, 199, 228–232
See application file for complete search history.

(56) References Cited

U.S. PATENT DOCUMENTS 6,323,447 B1 * 11/2001 Kondoh et al. ..... 200/182
6,559,420 B1 5/2003 Zarev
6,689,976 B1 2/2004 Dove et al.
6,743,991 B1 6/2004 Wong et al.
6,777,630 B1 * 8/2004 Dove et al. ..... 200/182
6,822,176 B1 11/2004 Fazzio
6,866,520 B2 * 3/2005 Chiang ..... 439/66
6,927,350 B2 * 8/2005 Kondoh et al. ..... 200/182
7,030,328 B1 * 4/2006 Beerling ..... 200/182

FOREIGN PATENT DOCUMENTS

EP 1235238 A2 8/2002
EP 1235242 A2 8/2002
WO 2006/093587 A2 8/2006

OTHER PUBLICATIONS

European Patent Office, Search Report, Dec. 5, 2007.

* cited by examiner

*Primary Examiner*—K. Richard Lee

(57) ABSTRACT

A switch comprises a first wafer having a thin-film structure defined thereon, a second wafer having a plurality of features defined therein, and a seal between the first wafer and the second wafer forming a two-wafer structure having a liquid metal microswitch defined therebetween.

13 Claims, 6 Drawing Sheets

ARCHITECTURE AND METHOD OF FABRICATION FOR A LIQUID METAL MICROSWITCH (LIMMS)

BACKGROUND OF THE INVENTION

Many different technologies have been developed for fabricating switches and relays for low frequency and high frequency switching applications. Many of these technologies rely on solid, mechanical contacts that are alternatively actuated from one position to another to make and break electrical contact. Unfortunately, mechanical switches that rely on solid-solid contact are prone to wear and are subject to a condition referred to as "fretting." Fretting refers to erosion that occurs at the points of contact on surfaces.

To minimize mechanical damage imparted to switch and relay contacts, switches and relays have been fabricated using liquid metals to wet the movable mechanical structures to prevent solid to solid contact. It is also possible to move a volume a liquid metal, creating a switch without any solid moving parts.

A liquid metal microswitch is described in U.S. Pat. No. 6,559,420, assigned to the assignee of the present application, and hereby incorporated by reference. The liquid metal microswitch in U.S. Pat. No. 6,559,420 uses gas pressure to divide one of two liquid metal switching elements to provide the switching function. For a SPDT (single pole, double throw) switch, one of the two liquid metal elements is always in contact with the input electrode and with one output electrode, and one liquid metal element is always in contact with the other output electrode (the isolated output electrode, also referred to as the isolated port). The application of pressure to the liquid metal that connects the input electrode to one of the output electrodes will toggle the switch to the other state, providing SPDT action.

Another liquid metal microswitch is described in commonly assigned, co-pending U.S. patent application Ser. No. 11/068,633, entitled "Liquid Metal Switch Employing A Single Volume Of Liquid Metal," filed on Feb. 28, 2005. The liquid metal microswitch in U.S. patent application Ser. No. 11/068,633, uses gas pressure to translate a single volume of liquid metal through a channel to provide the switching function.

SUMMARY OF THE INVENTION

In accordance with the invention a switch comprises a first wafer having a thin-film structure defined thereon, a second wafer having a plurality of features defined therein, and a seal between the first wafer and the second wafer forming a two-wafer structure having a liquid metal microswitch defined therebetween.

BRIEF DESCRIPTION OF THE DRAWINGS

The invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

The embodiments in accordance with the invention described below can be used in any application where it is desirable to provide fast, reliable switching. While described below as switching a radio frequency (RF) signal, the architecture and method of fabrication can be used for other switching applications, such as low frequency switching. Further, while described below in fabricating a switch that uses a single volume of liquid metal, the architecture and method of fabrication can be used to construct a switch that uses more than one volume of liquid metal to switch an electrical signal.

Figure 1A:
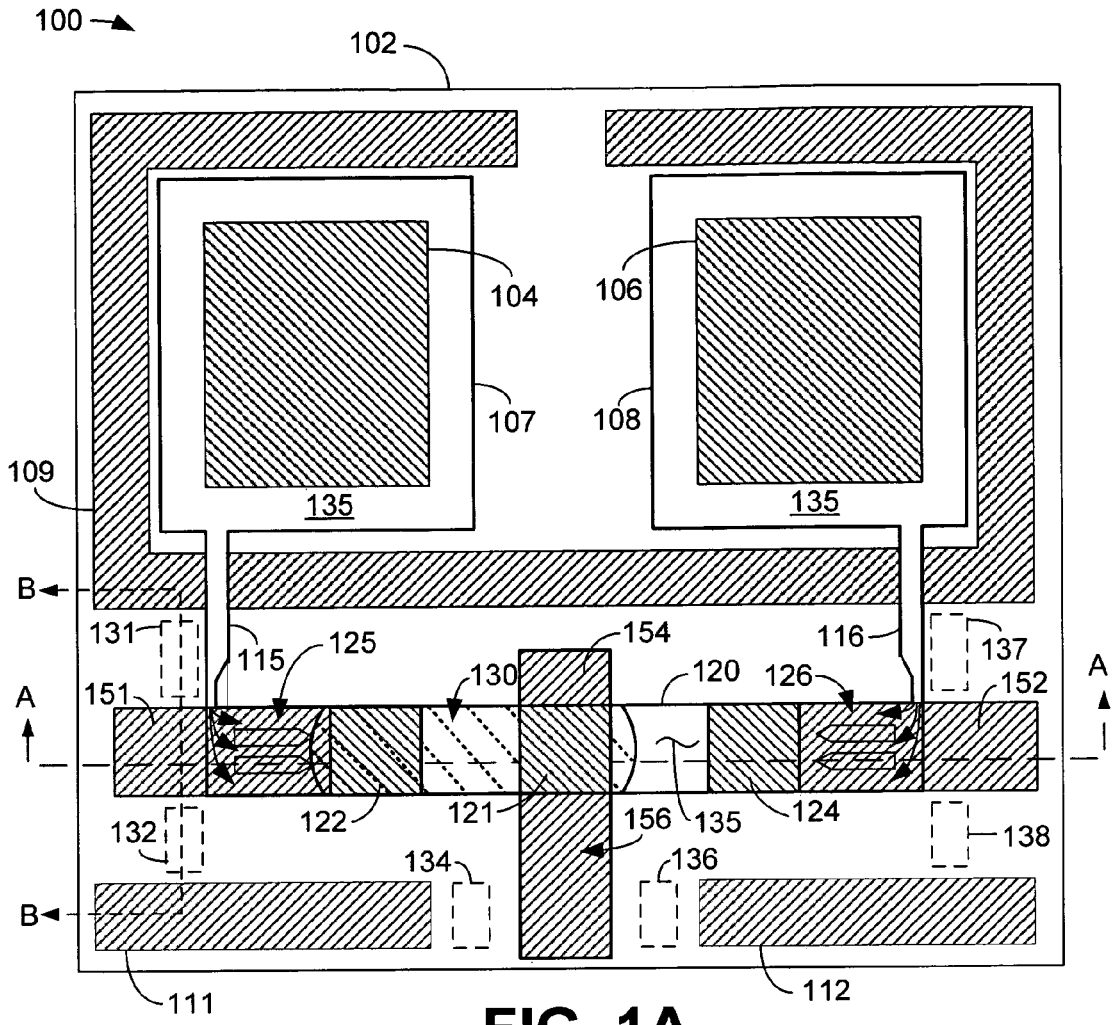
FIG. 1A is a schematic diagram illustrating a micro circuit for a SPDT switch.

FIG. 1A is a schematic diagram illustrating a micro circuit 100. In this example, the micro circuit 100 is a liquid metal microswitch that uses a single volume of liquid metal. The liquid metal microswitch 100 is fabricated on a substrate 102 that includes one or more layers (not shown in FIG. 1A), generally applied using thin-film semiconductor wafer processing methodologies. In one embodiment of the invention, the substrate 102 is a silicon wafer. The substrate 102 can be fully or partially covered with a dielectric material and other material layers. The liquid metal microswitch 100 can be a fabricated structure using, for example, thin film deposition techniques and/or thick film screening techniques which could comprise either single layer or multi-layer circuit substrates.

The liquid metal microswitch 100 includes heaters 104 and 106. The heater 104 resides within a cavity 107 and the heater 106 resides within a cavity 108. The liquid metal microswitch 100 also includes a cover, or cap, which is omitted from FIG. 1A The cavities 107 and 108 can be filled with a gas, which can be, for example, nitrogen ($N_2$) and which is illustrated using reference numeral 135. The cavity 107 is coupled via a sub-channel 115 to a main channel 120. Similarly, the cavity 108 is coupled via sub-channel 116 to the main channel 120. The main channel 120 is partially filled with a single droplet 130 of liquid metal. The droplet 130 is sometimes referred to as a "slug." The liquid metal, which is typically mercury, gallium alloy, or another liquid metal, is in constant contact with an input contact 121 and one of two output contacts 122 and 124.

In this exemplary embodiment, a portion 151 of metallic material underlying the contact 122 extends past the periphery of the main channel 120 onto the substrate 102. Similarly, a portion 152 of metallic material underlying the output contact 124 extends past the periphery of the main channel 120 onto the substrate 102, and portions 154 and 156 of the metallic material underlying the input contact 121 extend past the periphery of the main channel 120 onto the substrate 102. The metal portions 151, 152, 154 and 156 are generally covered by a dielectric, which is omitted from FIG. 1A for simplicity of illustration. Metallic material is also deposited, or otherwise applied to the substrate 102 approximately in regions 109, 111 and 112 to provide metal bonding capability to attach a cap. The cap can be a wafer of glass, for example, Pyrex®, or another material, or can be silicon. The cap, also referred to as a cover that defines walls and a roof, will be described below. Bonding the cap to the substrate 102 may also be accomplished by anodic bonding, in which case the regions 109, 111 and 112 would include a layer of amorphous silicon or polysilicon. In an alternative embodiment, the cap may be bonded directly to the substrate 102 without the layer of amorphous silicon or polysilicon. The output contacts 122 and 124 are preferably fabricated as small as possible to minimize the amount of energy used to separate the droplet 130 from the output contact 122 or from the output contact 124 when switching is desired. Further, minimizing the area of the contacts 121, 122 and 124 further improves electrical isolation among the contacts by minimizing the likelihood of capacitive coupling between the droplet 130 and the contact with which the droplet is not in physical contact.

In one embodiment, the main channel 120 includes a feature 125 and a feature 126 as shown. The features 125 and 126 can be formed in the surface of the cover by etching the material of the cover to define the features 125 and 126. In another embodiment, the features 125 and 126 can be fabricated on the surface of the substrate 102 as, for example, islands that extend upward from the base of the main channel 120 and that contact the edge of the liquid metal droplet 130 as shown. The features 125 and 126 determine the at-rest position of the liquid metal droplet 130.

To effect movement of the liquid metal droplet 130 and perform a switching function, one of the heaters 104 or 106 heats the gas 135 in the cavity 107 or 108 causing the gas 135 to expand and travel through one of the sub-channels 115 or 116. The expanding gas 135 exerts pressure on the droplet 130, causing the droplet 130 to translate through the main channel 120. When the position of the droplet 130 is as shown in FIG. 1A, the heater 104 heats the gas 135 in the cavity 107, thus expanding and forcing the gas through the sub-channel 115 and around the feature 125 so that a relatively constant wall of pressure is exerted against the droplet 130. The gas pressure thus exerted causes the droplet to move towards the output contact 124. The feature 125 and the feature 126 prevent the droplet 130 from extending past a definable point in the main channel 120, but allow the droplet 130 to easily de-wet from the features 125 and 126 when movement of the droplet 130 is desired.

Further, because a single droplet 130 is used in the microswitch 100, the likelihood that the droplet 130 will fragment into microdroplets that may enter the sub-channels 115 and 116 is significantly reduced when compared to a switch in which the liquid metal droplet is divided into multiple segments to provide the switching action.

Although omitted for clarity in FIG. 1A, the main channel 120 also includes one or more microscopic vents that are used to load the liquid metal into the main channel 120. The vents allow displaced gas to escape when loading the liquid metal material that forms the droplet 130. The microscopic vents can be sealed after the introduction of the liquid metal.

The main channel also includes one or more defined areas that include surfaces that can alter and define the contact angle between the droplet 130 and the main channel 120. A contact angle, also referred to as a wetting angle, is formed where the droplet 130 meets the surface of the main channel 120. The contact angle is measured at the point at which the surface, liquid and gas meet. The gas can be, in this example, nitrogen, or another gas that forms the atmosphere surrounding the droplet 130. A high contact angle is formed when the droplet 130 contacts a surface that is referred to as relatively non-wetting, or less wettable. The wettability is generally a function of the material of the surface and the material from which the droplet 130 is formed, and is specifically related to the surface tension of the liquid.

Portions of the main channel 120 can be defined to be wetting, non-wetting, or to have an intermediate contact angle. For example, it may be desirable to make the portions of the main channel 120 that extends past the output contacts 122 and 124 to be less, or non-wetting to prevent the droplet 130 from entering these areas. Similarly, the portion of the main channel in the vicinity of the features 125 and 126 may be defined to create an intermediate contact angle between the droplet 130 and the main channel 120.

In one embodiment, the liquid metal microswitch 100 also includes one or more gaskets shown using reference numerals 131, 132, 134, 136, 137 and 138. The gaskets will be described in greater detail below.

Figure 1B:
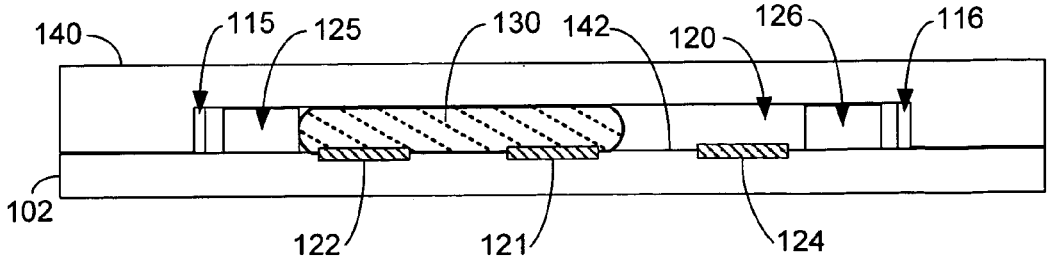
FIG. 1B is a simplified cross-sectional view through section A-A of FIG. 1A.

FIG. 1B is a simplified cross-sectional view through section A-A of FIG. 1A. The substrate 102 supports the liquid metal droplet 130 approximately as shown. The droplet 130 is in contact with the input contact 121 and the output contact 122, and rests against the feature 125. When gas pressure is exerted through the sub-channel 115, the gas 135 passes around and through portions of the feature 125, exerting pressure on the droplet 130 and causing the droplet 130 to move toward the output contact 124. Portions of the surface 142 of the substrate 102 include a material or surface treatment designed to produce an intermediate contact angle between the droplet 130 and the surface 142. An area of intermediate wettability forms an intermediate contact angle under the droplet and in the vicinity of, but not in contact with the input contact 121 and the output contacts 122 and 124.

In general, the contact angle between a conductive liquid and a surface with which it is in contact ranges between 0° and 180° and is dependent upon the material from which the droplet is formed, the material of the surface with which the droplet is in contact, and is specifically related to the surface tension of the liquid. A high contact angle is formed when the droplet contacts a surface that is referred to as relatively non-wetting, or less wettable. A more wettable surface corresponds to a lower contact angle than a less wettable surface. An intermediate contact angle is one that can be defined by selection of the material covering the surface on which the droplet is in contact and is generally an angle between the high contact angle and the low contact angle corresponding to the non-wetting and wetting surfaces, respectively. If the gas pressure exerted against the droplet causes the droplet 130 to overshoot the desired position, the intermediate contact angle helps cause the droplet 130 to return to the desired position in the vicinity of, and in contact with, the output contact 122 or 124. The liquid metal microswitch 100 also includes a cap 140, thus encapsulating the droplet 130.

Figure 2A:
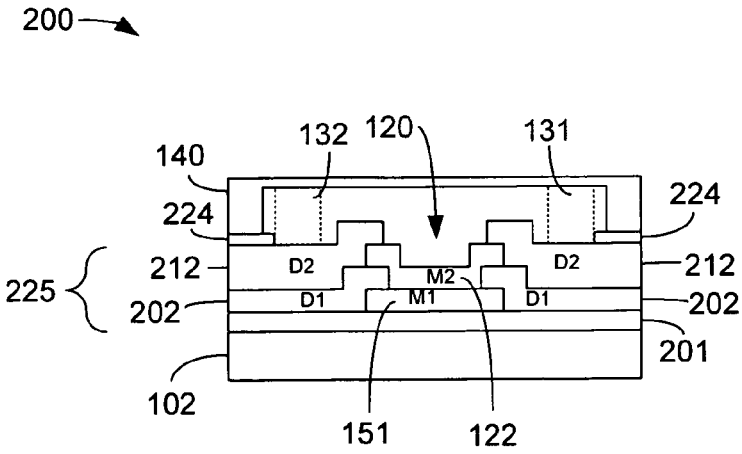
FIG. 2A is a schematic diagram illustrating a cross-section of a portion of the liquid metal microswitch taken through section B-B of FIG. 1 A.

FIG. 2A is a schematic diagram 200 illustrating a cross-section of a portion of the liquid metal microswitch 100 taken through section B-B of FIG. 1A, illustrating a two wafer architecture. A 1-3 micrometer (μm) thick isolating dielectric layer 201 of, for example, silicon dioxide ($SiO_2$) or silicon nitride (SiN) is applied over the surface of the substrate 102. Portions of the substrate 102 include a first metal layer 151 and a first selectively applied layer of dielectric 202 formed thereon. The first selective dielectric layer 202 is approximately 1 μm thick. The first metal layer 151 is approximately 1-2 μm thick and forms a waveguide layer for carrying the RF input and output signals. A second metal layer is approximately 0.5-1 μm thick and is formed over the first metal layer 151 and forms the portion of the output contact 122 that contacts the droplet 130 and a resistor material used in the heaters 104 and 106. The portion of the second metal layer that contacts the droplet 130 is preferably formed using a composition that is resistant to reacting with the metal from which the droplet 130 is formed. The first selective dielectric layer 202 can be formed using, for example, $SiO_2$ or SiN. A second selectively applied dielectric layer 212 approximately 200-1000 nanometers (nm) thick is formed over the first selective dielectric layer 202 and a portion of the second metal layer 122. The second selective dielectric layer 202 can be formed using, for example, SiO2. The isolating dielectric layer 201, first metal layer 151, second metal layer 122 and the second dielectric layer 212 form a thin-film structure 225 formed over the surface of the substrate 102. In one embodiment, the second dielectric layer 212 is planarized before further processing. Planarizing the second dielectric layer 212 ensures that the thin-film structure 225 is planar prior to attaching the cap 140. An example of a planarizing process is chemo-mechanical polishing (CMP).

In one embodiment, an approximately 200-500 nm thick layer 224 of amorphous silicon is applied over the second selective dielectric layer 212 in the regions 111 and 109 to allow the cap 140 to be anodically bonded to the substrate 102. Anodically bonding the cap 140 to the thin-film structure 225 creates a hermetic seal for the main channel 120. Other methods of attaching the cap 140 and creating a hermetic seal for the main channel 120 are also possible and would influence the choice of material in the regions 109 and 111. In accordance with another embodiment of the invention, optional gasket portions 131 and 132 seal the main channel 120 against the second dielectric layer 212 and the cap 140. The material from which the gasket portions 131 and 132 are formed can be a photo-definable polymer, such as, for example, polyimide. The gasket material eliminates leak paths for the pressurized gas, ensuring a seal for the main channel 120 and proper switch operation when a planarization step, like CMP, is not employed.

Figure 2B:
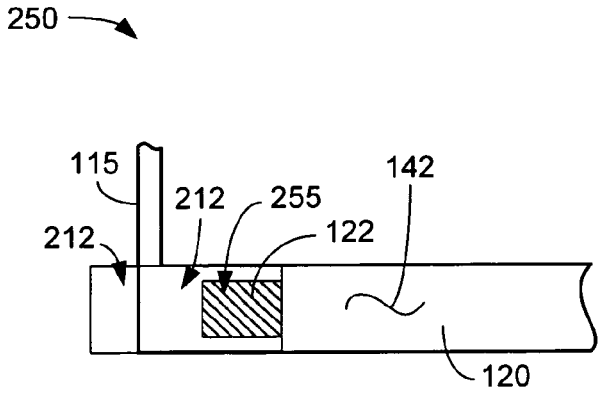
FIG. 2B is a schematic diagram illustrating a plan view of a portion of the main channel of the liquid metal microswitch of FIG. 1A.

FIG. 2B is a schematic diagram 250 illustrating a plan view of a portion of the main channel 120. Portions of the surface 142 of the base of the main channel 120 are covered with the first metal layer 151, the second selective dielectric 212 and the second metal layer, which forms the output contact 122. The output contact 122 is fabricated from a metal material that is designed to contact the droplet 130 (not shown). The metal material of the output contact 122 is in electrical contact with the metal material of the first metal layer 151 (FIG. 1A). An opening 255 is created in the second selective dielectric layer 212 to expose the portion of the second metal layer that will be the output contact 122.

Figure 3:
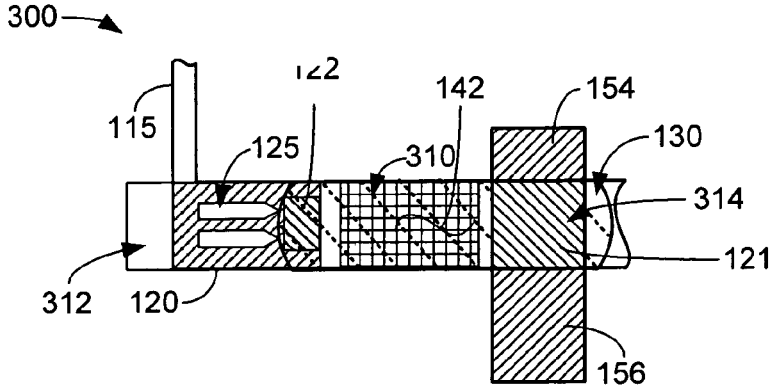
FIG. 3 is a schematic diagram illustrating a portion of the main channel of FIG. 1A.

FIG. 3 is a schematic diagram 300 illustrating a portion of the main channel 120 of FIG. 1A. Much of the second selective dielectric 212 in the channel 120 is omitted from FIG. 3 for clarity. The portion of the main channel 120 includes the feature 125 and also shows the droplet 130. An intermediate wetting region 310 is illustrated approximately as shown in FIG. 3 to assist in preventing the liquid metal droplet 130 from traversing past the output contact 122 and to reposition the droplet 130 over the output contact 122 should the gas pressure cause the droplet 130 to overshoot the output contact 122. A similar intermediate wetting region would be provided in the vicinity of output contact 124 (FIG. 1A).

The main channel 120 also includes a non-wetting region 312 (part of the second selective dielectric layer 212) to further prevent the droplet 130 from entering non-wetting region 312 of the main channel 120. The main channel 120 also includes a wetting region 314 (i.e., the input contact 121 of FIG. 1A). Although omitted for clarity, the surface of the cap 140 that contacts the droplet 130 may have a wetting pattern similar to the wetting pattern on the surface 142.

Examples of features that define a wetting pattern and influence the contact angle formed by the droplet 130 with respect to the surface 142 include the type of material that covers the surface 142, the selective patterning of a wetting material formed over a non-wetting surface, and microtexturing to alter the wettability of portions of the surface 142, etc.

Figure 4A:
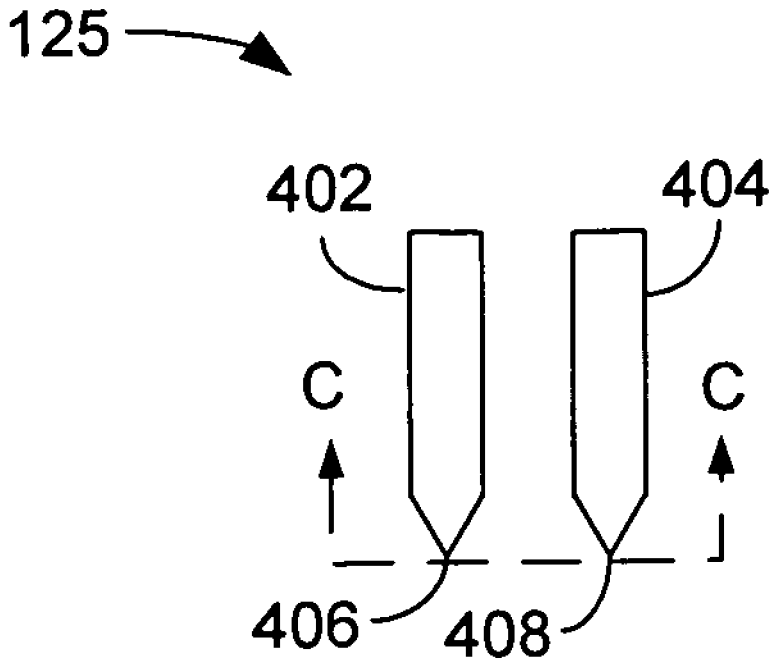
FIG. 4A is a plan view illustrating the feature of FIG. 1A.

FIG. 4A is a plan view illustrating the feature 125 of FIG. 1A. The feature 125 includes sub-feature 402 and sub-feature 404. The sub-features 402 and 404 can be formed in the main channel 120 (FIG. 1A) approximately as shown. In one embodiment, the sub-features 402 and 404 are defined in a surface of the cap 140. The sub-feature 402 includes a point 406 and the sub-feature 404 includes a point 408. The points 406 and 408 are designed to provide minimal contact with the droplet 130 (FIG. 1A) while determining the at-rest position of the droplet 130.

Figure 4B:
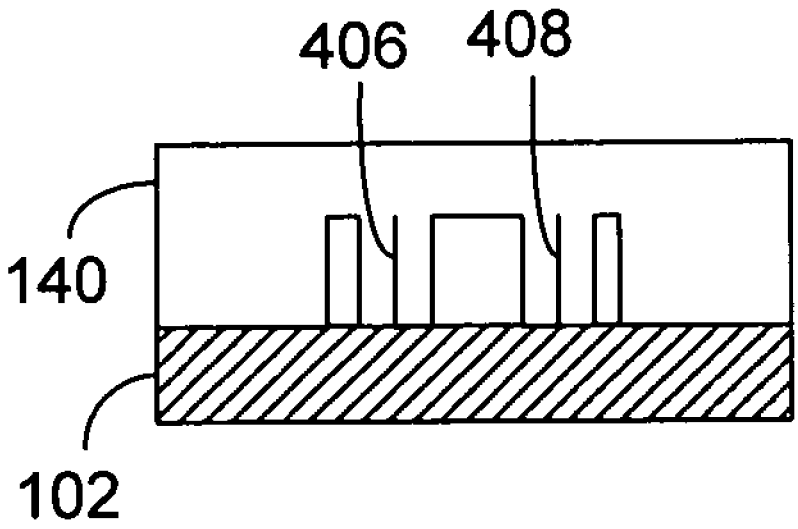
FIG. 4B is a schematic diagram illustrating the feature in FIG. 4A.

FIG. 4B is a schematic diagram illustrating the feature 125 in FIG. 4A. In FIG. 4B, the feature 125 is defined in the cap 140 by, for example, photolithographic etching. The points 406 and 408 illustrate the portions of the feature 125 with which the liquid metal droplet 130 would come into contact as the liquid metal droplet 130 crosses either the RF output contact 122 or the RF output contact 124. The pointed shape of the feature 125 would reduce the amount of pressure required for the liquid metal droplet 130 to de-wet therefrom when gas pressure influences the liquid metal droplet 130 to translate in the direction away from the points 406 and 408. The feature 125 can also be coated with a substance that alters the contact angle between the droplet 130 and the feature 125. The feature 126 is similar to the feature 125. The detail of the thin-film structure 225 on th surface of the substrate 102 is omitted from FIG. 4B for clarity.

Figure 5A:
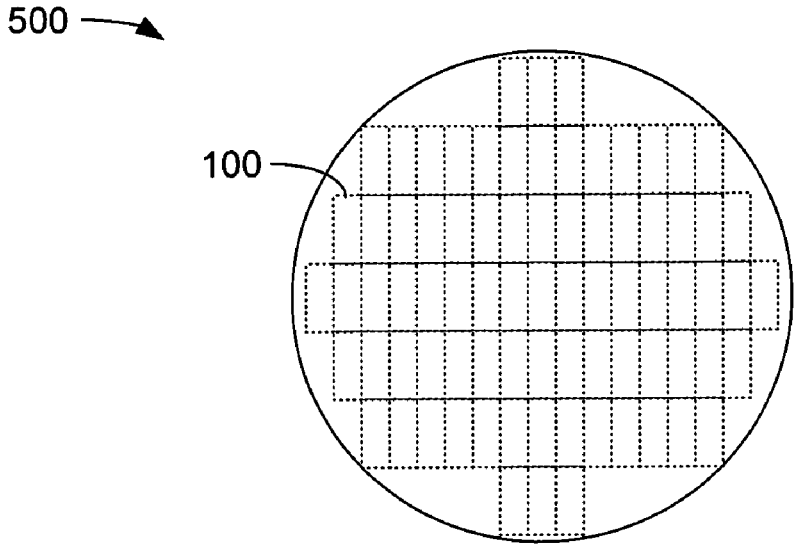
FIG. 5A is a schematic diagram illustrating a plan view of a wafer assembly including a plurality of liquid metal microswitches.

FIG. 5A is a schematic diagram illustrating a plan view of a wafer assembly 500 including a plurality of liquid metal microswitches 100 formed therein. The liquid metal microswitches 100 are illustrated using dotted lines because they are formed on the surfaces of the respective wafers that comprise the wafer assembly 500, the detail of which will be described below. Many hundreds or thousands of liquid metal microswitches 100 are typically formed on a wafer assembly 500.

Figure 5B:
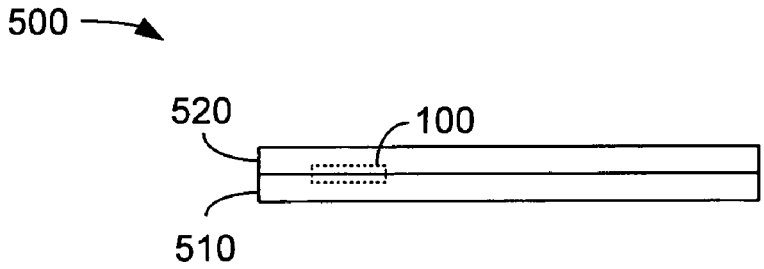
FIG. 5B is a schematic diagram illustrating a side view of the wafer assembly of FIG. 5A.

FIG. 5B is a schematic diagram illustrating a side view of the wafer assembly 500 of FIG. 5A. The wafer assembly 500 comprises a first wafer 510 and a second wafer 520. The first wafer 510 forms the substrate (102) and the second wafer 520 forms the cap (140) of the liquid metal microswitch 100. The thin-film structure 225 described above is formed on a surface of the first wafer 510. The main channel 120, the features 125 and 126, and any other features, such as the cavities 107 and 108 (FIG. 1A) and the sub-channels 115 and 116 described above, are defined in a surface of the second wafer 520. The first wafer 510 can be, for example, silicon and the second wafer 520 can be, for example, glass. However, the first wafer 510 can be glass and the second wafer 520 can be silicon, or both wafers 510 and 520 can be formed of the same material. In one embodiment of the invention, the first wafer 510 is approximately 650 μm thick and the second wafer 520 is approximately 650 μm thick. In one embodiment, the first wafer 510 and the second wafer 520 are anodically bonded together, as described above, to form a two wafer hermetically sealed liquid metal microswitch 100.

Figure 5C:
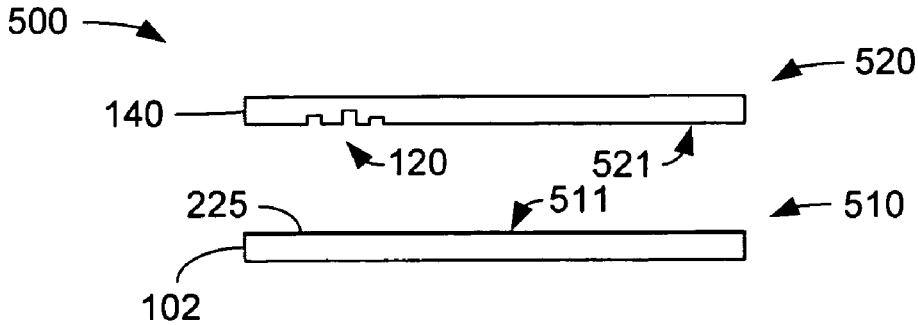
FIG. 5C is a schematic diagram illustrating a detail view of the wafer assembly of FIG. 5B.

FIG. 5C is a schematic diagram illustrating a detail view of the wafers 510 and 520 of FIG. 5B. The thin-film structure 225, which is typically approximately 2-10 μm thick is formed on a surface 511 of the first wafer 510. The main channel 120, and the features 125 and 126, and any other features, such as the cavities 107 and 108 (FIG. 1A) and the sub-channels 115 and 116, are defined in a surface 521 of the second wafer 520. The features that are defined in the surface 521 of the second wafer 520 can be defined using, for example, photo-lithography, or another technique for defining or patterning a surface, and are formed approximately 20-40 μm deep into the surface of the second wafer 520.

Figure 6:
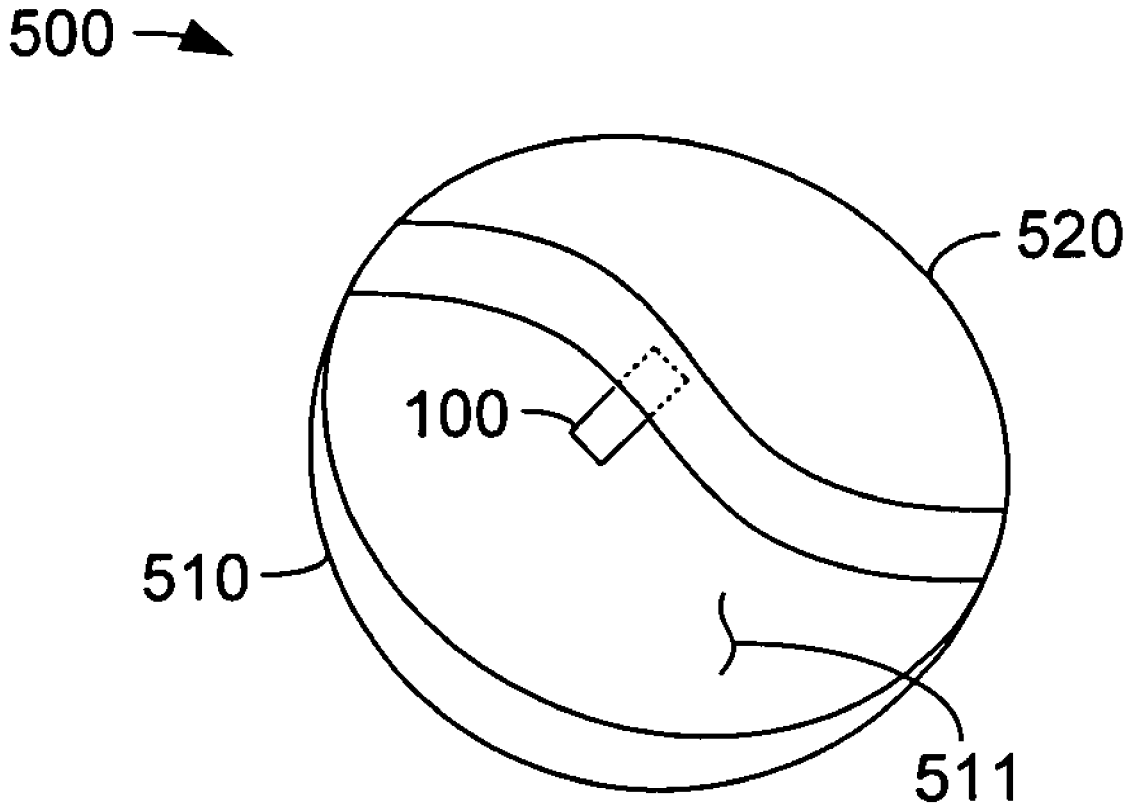
FIG. 6 is a schematic diagram illustrating a cut-away view of the wafer assembly of FIGS. 5A, 5B and 5C.

FIG. 6 is a schematic diagram illustrating a cut-away view of the wafer assembly of FIGS. 5A, 5B and 5C. A portion of the second wafer 520 is exposed to reveal the liquid metal microswitch 100, portions of which are formed on the surface 511 of the first wafer 510 and portions of which are formed in the surface 521 (not shown in FIG. 6) of the second wafer 520.

Figure 7:
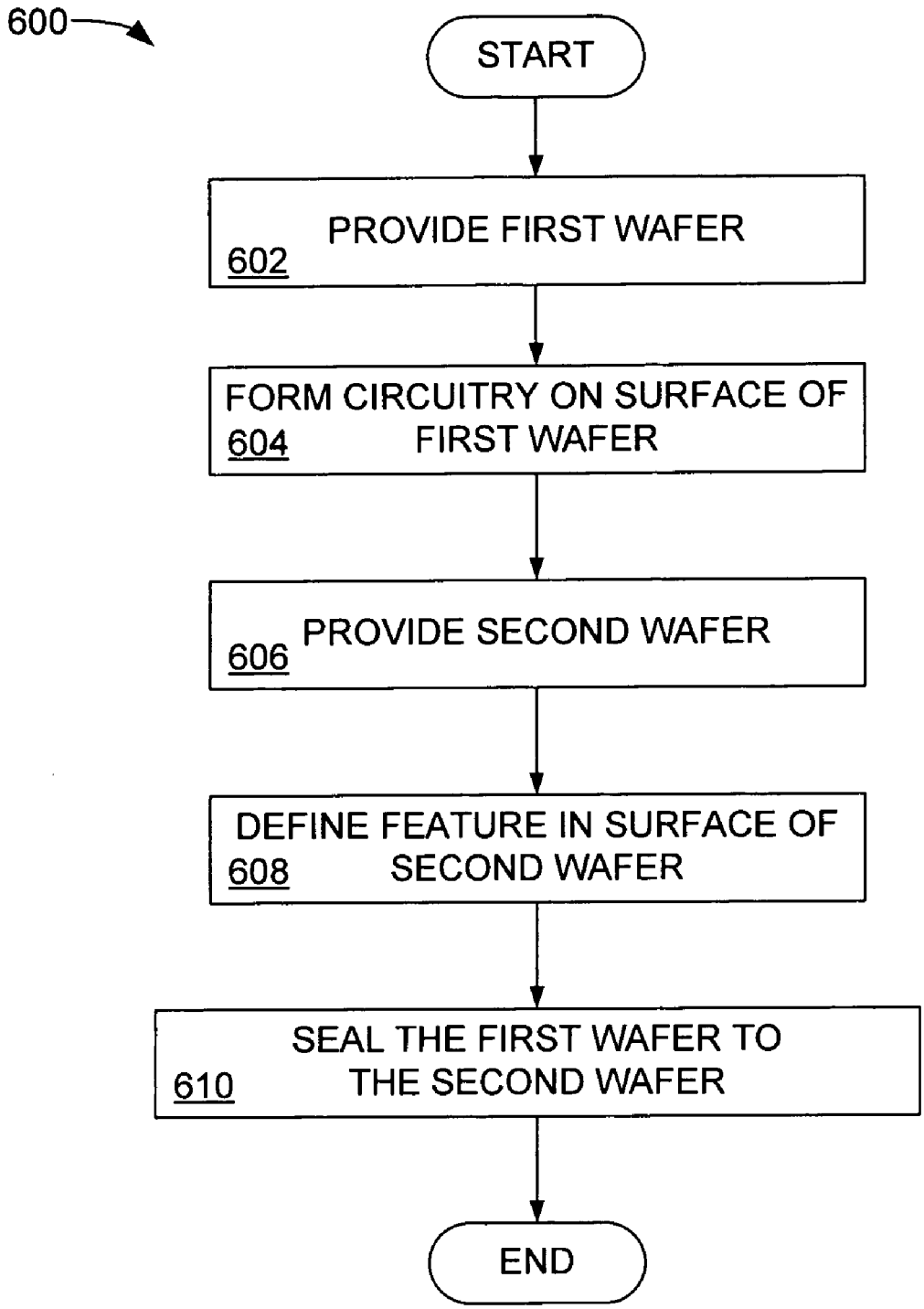
FIG. 7 is a flowchart describing a method of forming a liquid metal microswitch in accordance with an embodiment of the invention.

FIG. 7 is a flowchart 600 describing a method for forming a liquid metal microswitch in accordance with an embodiment of the invention. Although specific operations are disclosed in the flowchart 600, such operations are exemplary. Other embodiments of the present invention can be fabricated using other operations or variations of the operations recited in the flowchart 600. Further, the operations in the flowchart 600 can be performed in an order different that that described. In block 602, a first wafer is provided. The first wafer can be, for example, silicon. In block 604, circuitry is formed on a surface of the first wafer. For example, the circuitry described above cam be formed on the surface of the first wafer using thin-film semiconductor wafer processing methodologies.

In block 606 a second wafer is provided. The second wafer can be, for example, a glass material such as Pyrex®. In block 608, one or more features, such as fluid channels, are defined in a surface of the second wafer. The features can be defined in the surface of the second wafer by, for example, photo-lithographic etching, or other etching processes. In block 610, the first wafer is sealed to the second wafer. The circuitry formed on the surface of the first wafer and the features defined in the surface of the second wafer form a liquid metal microswitch that is encapsulated when the first and second wafers are joined.

This disclosure describes illustrative embodiments in accordance with the invention in detail. However, it is to be understood that the invention defined by the appended claims is not limited by the embodiments described.

What is claimed is:

1. A switch, comprising:

a first wafer having a thin-film structure defined thereon;

a second wafer having a plurality of features defined therein; and a seal between the first wafer and the second wafer forming a two-wafer structure having a liquid metal microswitch defined therebetween.

2. The switch of claim 1, in which the material of the first wafer and the second wafer is chosen from silicon and glass.

3. The switch of claim 2, in which a surface of the first wafer comprises a plurality of material layers.

4. The switch of claim 3, in which a surface of the second wafer comprises a plurality of fluid cavities.

5. The switch of claim 3, in which the second wafer comprises at least one feature configured to determine the at-rest position of a droplet of conductive liquid.

6. The switch of claim 3, in which the seal is hermetic and is created by a layer of amorphous silicon between the first wafer and the second wafer and in which the first wafer is anodically bonded to the second wafer.

7. The switch of claim 3, in which the seal is created by a gasket between the first wafer and the second wafer.

8. The switch of claim 7, in which the gasket is a photo-definable polymer.

9. A switch, comprising:

a first wafer having a thin-film structure defined thereon;

a second wafer having a plurality of features defined therein, one of the features being a fluid channel;

an input contact and at least one output contact defined in the fluid channel;

at least one droplet of conductive liquid located in the fluid channel;

a heater configured to heat a gas, the heated gas expanding to cause the droplet to translate through the channel; and a seal between the first wafer and the second wafer forming a two-wafer structure.

10. The switch of claim 9, in which the material of the first wafer and the second wafer is chosen from silicon and glass.

11. The switch of claim 10, in which the second wafer comprises at least one feature configured to determine the at-rest position of a droplet of conductive liquid.

12. The switch of claim 11, in which the seal is hermetic and is created by a layer of amorphous silicon between the first wafer and the second wafer and in which the first wafer is anodically bonded to the second wafer.

13. The switch of claim 10, in which the seal is created by a gasket between the first wafer and the second wafer.

* * * * *